US005966982A

United States Patent [19]

Mello et al.

[11] Patent Number: 5,966,982

[45] Date of Patent: Oct. 19, 1999

[54] DIMPLING DIE SET

[75] Inventors: Keith Mello, Manchester; H. Thomas Nelson, Bedford, both of N.H.

[73] Assignee: Framatome Connectors USA, Inc., Fairfield, Conn.

[21] Appl. No.: 09/038,551

[22] Filed: Mar. 11, 1998

[51] Int. Cl.[6] ..... B21D 37/10

[52] U.S. Cl. ..... 72/416; 72/412; 72/703; 72/453.15

[58] Field of Search ..... 72/412, 416, 453.16, 72/453.15, 409.01, 703

[56] References Cited

U.S. PATENT DOCUMENTS

| | | | |
|---|---|---|---|
| 175,613 | 4/1876 | Long | 72/412 |
| 1,373,725 | 4/1921 | Heiby | 72/412 |
| 3,359,773 | 12/1967 | Stuchbery | 72/412 |
| 4,261,194 | 4/1981 | Stephens | 72/453.15 |
| 5,062,290 | 11/1991 | Hoover | 72/453.16 |
| 5,084,963 | 2/1992 | Murray | 72/453.16 |
| 5,193,379 | 3/1993 | Ferraro | 72/453.16 |
| 5,819,579 | 10/1998 | Roberts | 72/412 |

FOREIGN PATENT DOCUMENTS

| | | | |
|---|---|---|---|
| 550019 | 5/1932 | Germany | 72/412 |
| 1627811 | 8/1976 | Germany | 72/453.15 |
| 148017 | 5/1981 | Germany | 72/412 |

*Primary Examiner*—Daniel C. Crane
*Attorney, Agent, or Firm*—Perman & Green, LLP

[57] ABSTRACT

A hydraulic compression tool comprises a frame and a first die and an opposite second die mounted on the frame. The first die is immovably connected to the frame and the second die is movably connected to the frame along a line of action and is positioned oppositely of the first die. The first die is positioned on the frame along the line of action of the second die. At least one of the first and second die has a work piece engaging surface which is disposed relative to the line of action at an angle other than perpendicular thereto.

13 Claims, 7 Drawing Sheets

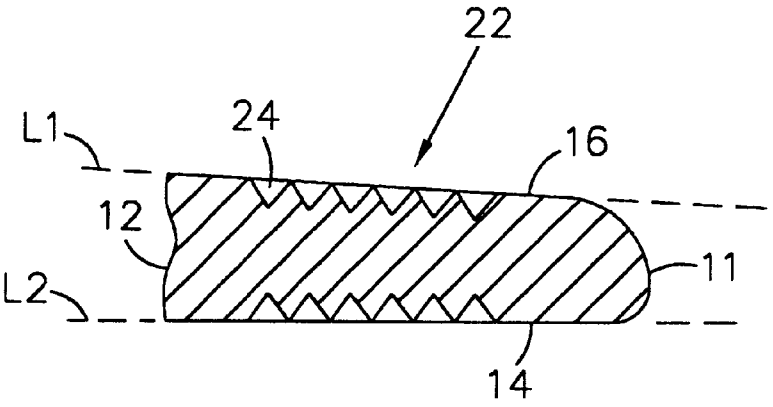
FIG. 4
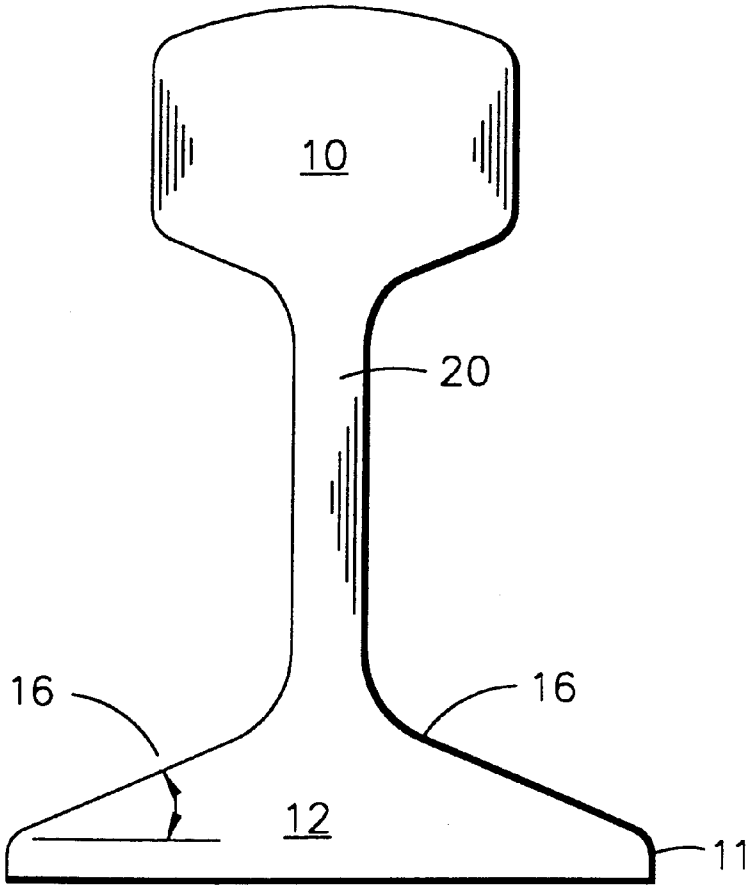
FIG. 5
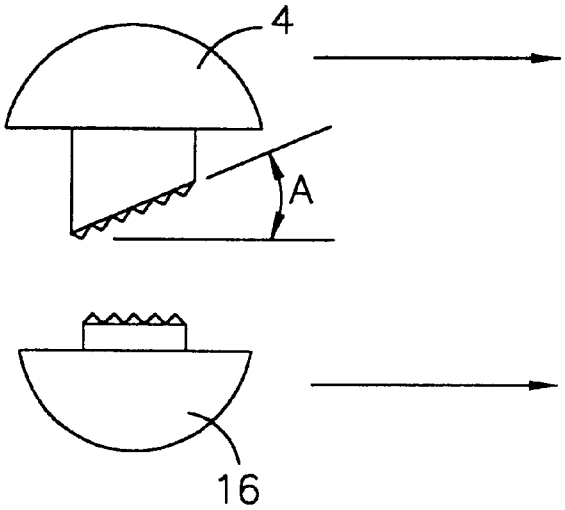

DIMPLING DIE SET

The present invention corresponds to copending U.S. application Ser. No. 09/013,506 entitled Hydraulic Tool Alignment Guard, which was filed on Jan. 26, 1998 under Express Mail label No. EM174706270US, which application is being hereby incorporated by reference.

BACKGROUND OF THE INVENTION

The present invention relates to an improved die set usable in a compression tool, and relates more particularly to a dimpling die set for use on a flange or the like of a workpiece wherein each dimpling die has an array of projections which deform the surface of the workpiece upon compression by the tool.

This invention relates to a die set to be used for the installation of a compression rail connector to railroad rails for grounding wires, or wires which are used for signalling, communication, or power applications. In the installation of such compression connectors, it is necessary to create a dimpled surface on a rail upon which surface, the connector will be placed. The dimpled surface with the compression connector acts to create greater surface area on the underlying contact area of the workpiece so as to insure better conductivity and redundancy in the connection.

In addition, the formation of a dimpling pattern on the surface of a workpiece creates an enhanced mechanical connection between the compression connector and the surface which is contacted. This mechanical interface between correspondingly formed surfaces of the die and the connector has many advantages. Specifically, when a compression rail connector is crimped onto the rail foot over the preformed dimples, the material of the connector flows into the dimples and effectively interlocks the connector with the rail foot thus providing a strong attachment of a connector to the rail. Thus, the dimpling of one or more surfaces of a rail is desirable for enhanced electrical connection between the connector and the rail as well as for providing a mechanical connection therebetween.

In order to create dimpling surfaces on a railroad rail, it is necessary to provide a tool which is made of a material that is harder than the workpiece surface onto which a dimple is to be made. In addition, the tool must have projections which likewise are capable of causing the dimpling, and so must have a geometry which is capable of deforming the surface of the member, e.g. the rail, as well as providing a geometry sufficiently corresponding to the geometry of the connector which will be seated onto the then formed dimpled surface. In addition, in the circumstance where the surface to be dimpled is disposed at an angle other than 0° to the horizontal, it is often necessary to orient the surface which contains the deforming dimpling projections at an angle which is congruent with the angle of the surface to be dimpled. For example, the base flange of a railroad rail has a top surface which is angled approximately 14° with the horizontal. If the projections on the upper die which engage with the upper surface were not disposed at such an angle relative to this surface, then there would be created only a partial dimpled area, which would be ineffectual for the purposes of a successful long lasting electrical and mechanical connection.

Accordingly, it is an object of the present invention to provide a dimpling die set wherein the projections which are responsible for causing deformation in a surface to be dimpled are arranged at an angle corresponding to the angle of the surface to which the die is to be impacted.

Also, with such dimpling die sets, it is important to be able to set the die at a location on a surface, for example a given distance from a side edge, so that the placement of the dimpled surface is uniform and constant.

It is still a further object of the invention to provide a dimpling die set of the aforementioned type wherein the die has a locating portion which locates the die at a given distance from one side edge of the surface to be deformed so as to produce repeatable, uniformly located dimpled areas on the surface to be worked.

Still a further object of the invention is to provide a die of the aforementioned type which is capable of being used in standard compression tools.

Other objects and advantages of the invention will become apparent from the following disclosure and the appended claims.

SUMMARY OF THE INVENTION

The invention resides in a hydraulic compression tool which comprises a frame and a first die and an opposite second die mounted on the frame. The first die is immovably connected to the frame and the second die is movably connected to the frame along a line of action and is positioned oppositely of the first die. The first die is positioned on the frame along the line of action of the second die. At least one of the first and second die has a work piece engaging surface which is disposed relative to the line of action at an angle other than perpendicular thereto.

Ideally, the frame includes a one die holder and another die holder and the first die is adapted to be received within the one die holder of the compression tool and the second die is adapted to be received within the other die holder of the compression tool, and the work piece engaging surface of at least one of the first and second die being a dimpling surface defined by a plurality of pyramids formed thereon extending toward the work piece.

Preferably, at least one of the work piece engaging surfaces is disposed relative to the line of action of the second die at an angle other than perpendicular thereto and the pyramids are angled and extend towards the line of action and each of the die includes a base and a die pad integrally connected with one another and each base of the die has a generally partially cylindrical form.

Preferably, the frame includes one die holder and another die holder the first die is adapted to be received within the one die holder of the compression tool about the generally cylindrical form thereof and the second die is adapted to be received within the other die holder of the compression tool about the generally cylindrical form thereof and the first die includes a die stop which extends substantially perpendicularly to the die pad portion of the first die.

The invention also resides in a dimpling die set which comprises a locating die adapted to be mounted to a tool, the locating die has a base portion and a work piece engaging surface for compression against one side of a work piece. The moving die is adapted to be mounted to a tool, the moving die has a base portion and a work piece engaging surface for compression against another side of the work piece. The angle of the work piece engaging surface of the moving die relative to the base portion thereof is usually substantially different from the angle of the work piece engaging surface of the moving die relative to the base portion thereof.

Ideally the work piece engaging surface of at least one of the locating and moving dies being a portion of the pad having a dimpling surface defined by a plurality of pyramids formed thereon extending toward the work piece.

Preferable, the pyramids extend towards the workpiece in a direction generally parallel to the line of action, and the work piece engaging surface of the first die being disposed relative to the line of action of the second die at an angle of about 14°.

Desirably, each of the first and second dies are formed from a metallic material of suitable hardness for enabling dimpling of a railroad rail when each of aid first and second dies is compressed onto to the rail under compression force.

BRIEF DESCRIPTION OF THE DRAWINGS

FIG. 4 is a partially fragmentary vertical section taken along line 4—4 in FIG. 3 showing dimpling formed in upper and lower surfaces of the flange.

FIG. 5 is a front elevation exploded view of a rail with dimpling dies positioned as they would be in a compression tool over respective areas of the rail.

DETAILED DESCRIPTION OF THE PREFERRED EMBODIMENT

Figure 1:
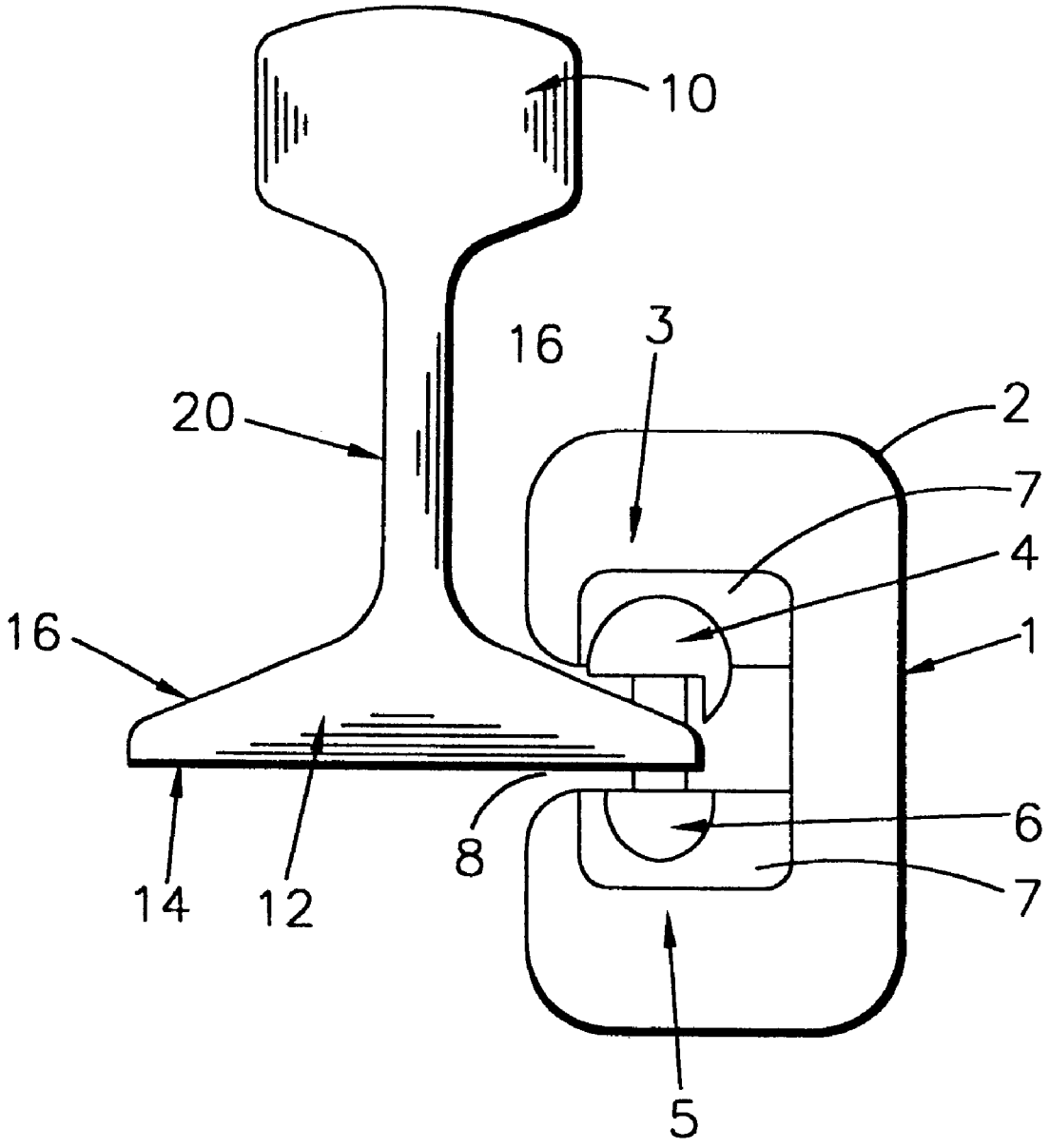
FIG. 1 is a side elevation view showing a compression tool working on a surface of a railroad rail.

Referring now to FIG. 1, it should be seen that a compression tool illustrated generally as 1 is disclosed which embodies the present invention. The compression tool 1 is one that is readily commercially available and is sold by Framatome Connectors International under Part No. Y-750 series and includes a frame 2 on which is mounted a nonmovable die holder 3 mounting a first die 4 and a movable die holder 5 mounting a second die 6. For purposes of this discussion, the lower die 6 is referenced as the movable die while the upper die 4 is shown as the stationary die, but it is well within the purview of the invention to use the tool 1 such that the orientation of the stationary and movable die are reversed. Each of the die 4 and 6 in the deenergized state of the tool 1 provides for a space 8 into which a portion of a workpiece 10 is inserted.

The workpiece 10 as illustrated, is a rail from a railroad line having a lower flange 12 defined by a base surface 14 and two inclined surfaces 16,16 which are commonly met by a vertically extending web 20.

Figure 2:
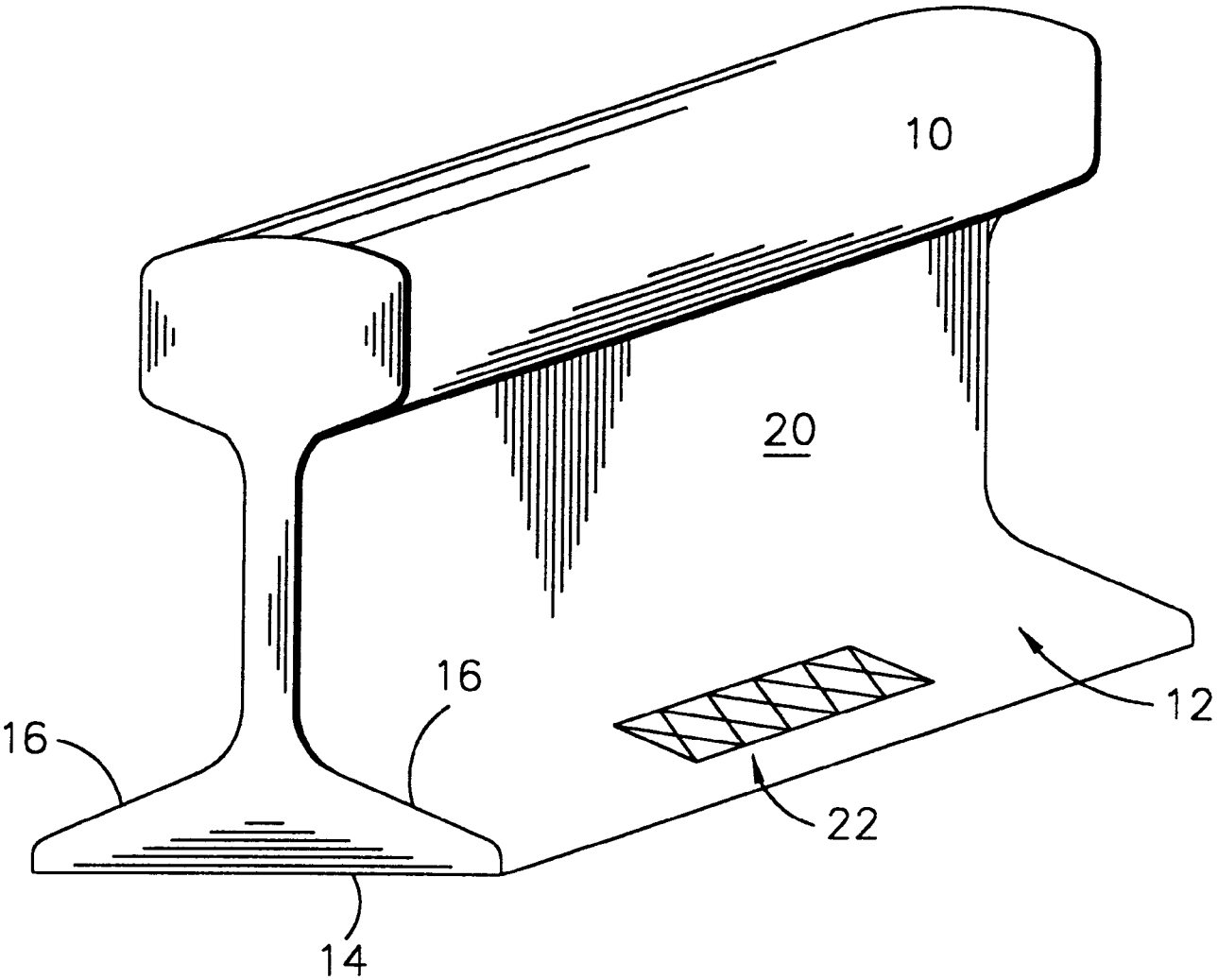
FIG. 2 is a partially fragmentary perspective view of a railroad rail showing a dimpled area in the foreground.
Figure 3:
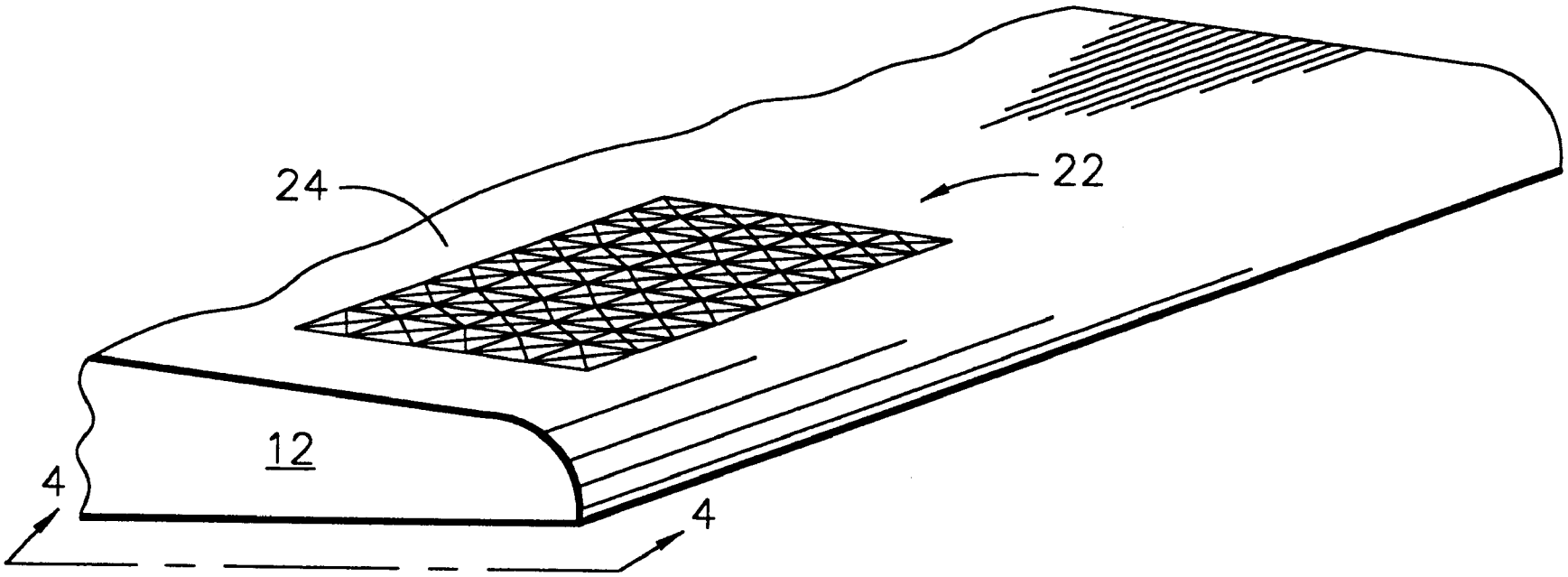
FIG. 3 is a partially fragmentary perspective view of a flange of the rail shown in FIGS. 1 and 2 with the dimpled areas shown in greater detail.

As best is seen in FIGS. 2–4, the flange 12 on the upper surface 16 thereof and along a corresponding lower region of the undersurface 14 has a deformed area, which for purposes of the present invention, will be referred to as a dimpling surface 22. The dimpling surface is formed by the high action compression force caused by the cooperation of the non-movable and the hydraulically movable die 4 and 6 against the corresponding upper and lower surfaces 16 and 14 of the flange 12.

As can be seen from FIG. 4, individual deformations 24 make up the dimpling surface 22, and are oriented along lines of orientation L1 and L2 which extend generally parallel with the upper surface 16 and the lower surface 14, respectively, of the rail 10. This is an important feature that the connector for the flange which is compressed, will have material flow correspondingly with the dimpled surface so as to have a corresponding orientation which is both similarly angled and shaped to the individual deformations 24,24 formed on the surfaces 14 and 16 of the flange 12.

Figure 6:
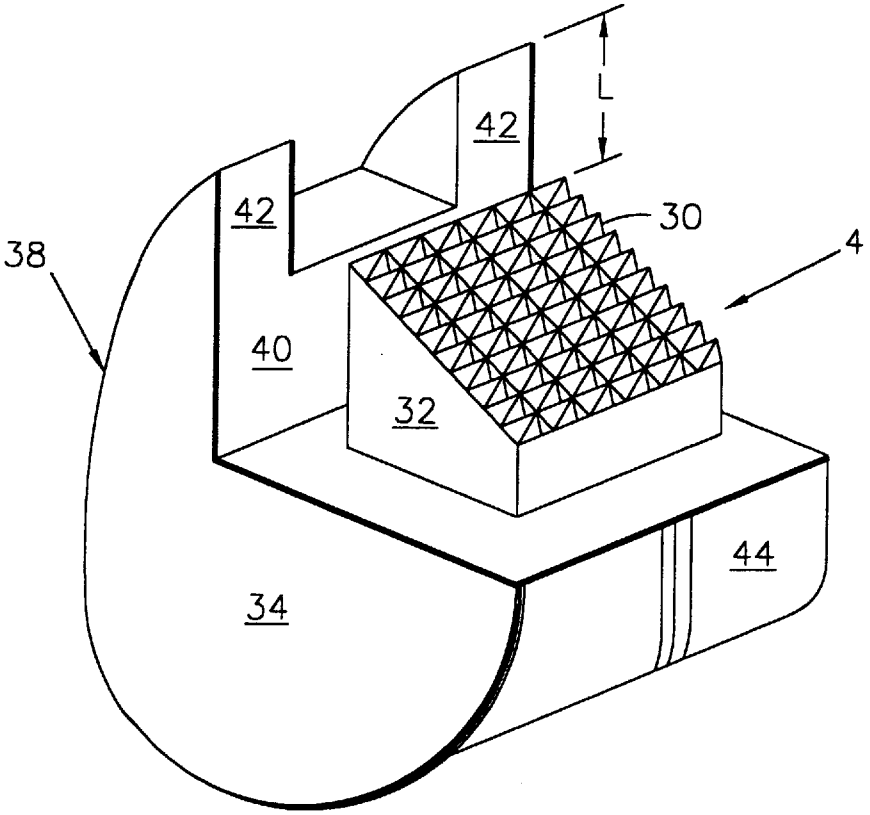
FIG. 6 is a perspective view showing the angled die apart from the compression tool.
Figure 9B:
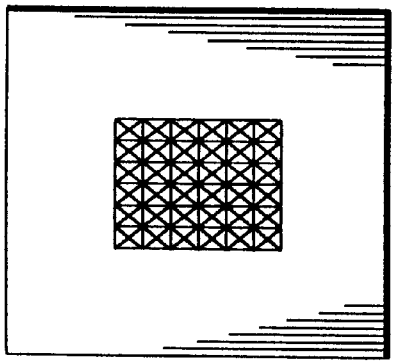
FIG. 9*b* is a top plan view of the dimpling die shown in FIG. 9*a*.
Figure 9C:
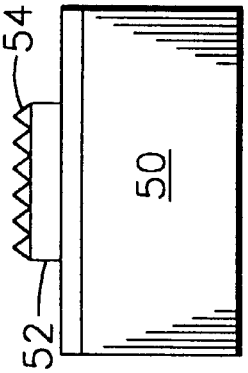
FIG. 9*c* is a front elevation view of a dimpling die shown in FIG. 9*a*.
Figure 9A:
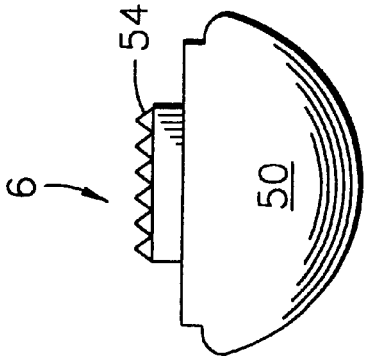
FIG. 9*a* is a side elevation view of the dimpling die shown in FIG. 8.
Figure 8:
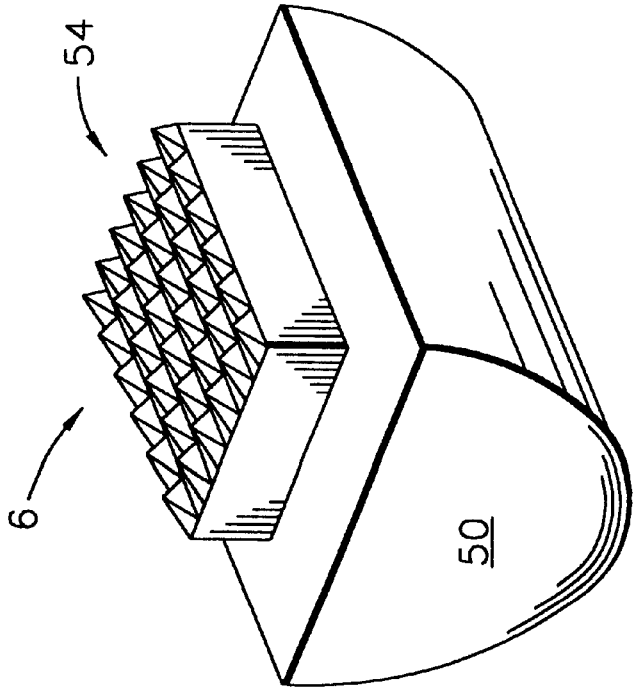
FIG. 8 is a perspective view of an opposite dimpling die having 0 angle surface area.

As best illustrated in FIGS. 5 and 6, and in accordance with the invention, it should be seen that the first die 4 is provided and is associated with the upper surface 16 of the flange 12 and the cooperating second die 6 is provided and is associated with the lower surface 14 of the rail 10. The first die 4 is an integrally formed member comprised of an array of a plurality of deforming projections 30,30 (corresponding to the deformations 24,24), a part cylindrical base 34, and a positioning platform or pad 32 interposed between the plurality of the deforming projections 30 and the base 34 to effect a given orientation of the array of projections relative to the base.

As best illustrated in FIG. 6, the base 34 of the first die 4 includes a locating portion 38 which extends tangentially from the otherwise partially cylindrical form of the base 34. The locating portion 38 has a straight face surface 40 which defines a bifurcated pair of locating arms 42,42. Referring back to FIG. 1, it should be seen that each die holder 3 and 5 includes a pair of side plates 7,7 which laterally constrain each of the die 4 and 6 within the frame of the compression tool 1. The locating arms 42,42 and the locating platform 32 extend beyond the side plate 7,7 so as to contact with the side edge 11 of the rail 10. The base 34 of the die 4 further includes a groove 44 which further serves to locate the die 36 centrally within the die holder 3.

As can be seen from FIGS. 1 and 6, each of the locating arms 42,42 has a length L which is sufficiently long to extend downwardly beyond the projections 30,30 so as to locate the inner surface 40 of the arms 42,42 in engagement with the side edge 11 of the flange 12. In this way, as best illustrated in FIG. 1, the first die 4 is provided with a locating mechanism whereby the projections 30 can be consistently and repeatedly oriented at a given distance from the side edge of the rail from one process to the next.

Figure 7B:
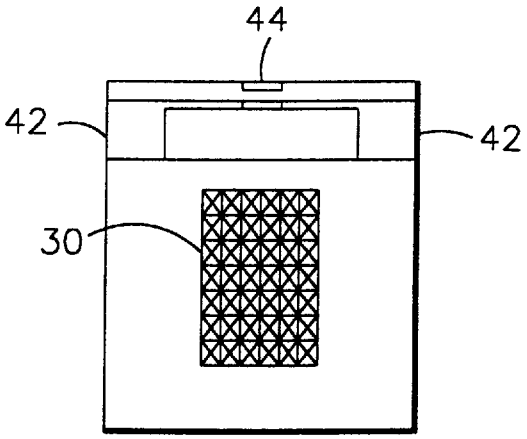
FIG. 7*b* is a top plan view of the dimpling die shown in FIG. 7*a*.
Figure 7C:
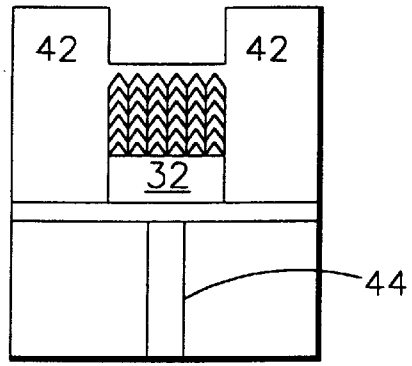
FIG. 7*c* is a front elevation view of the dimpling die as shown in FIG. 7*a* as seen looking from the right of the object.
Figure 7A:
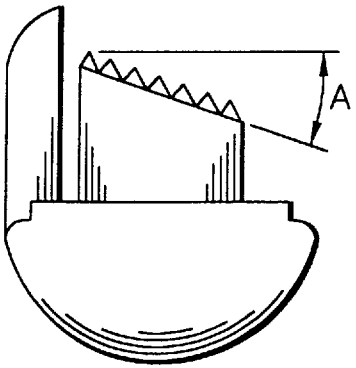
FIG. 7*a* is a side elevation view of the dimpling die shown in FIG. 6.

As illustrated in FIGS. 7*a*–7*c*, the platform or die pad 32 disposes the array of projections 30,30 at an angle A, which in the preferred embodiment, is equal to approximately 14° a typical match angle for a rail foot for rail sizes 115 RE, 119 RE, 132 RE, 133 RE, 136 RE and 140 RE.

Referring now to FIGS. 8, 9*a* through 9*c*, it should be seen that the second die 6 is a straight die comprised of a base 50 on which is integrally formed a mounting platform or pad 52 which carries a plurality of deforming projections 54,54. The base 50 is partially circular in side view and is elongate in length so as to form a partial cylindrical shape which is fittable within the correspondingly recess of the die holder 5. The die holder 5 includes side plates 7,7 which capture the base 50 of the second die and maintain it in its 0° inclination relative to the projection pattern on the first die 4. It should be appreciated here that the second die 6 can be made blank with no deforming projections, such that only the surface 16 is deformed upon application of the compressive force of the tool.

Figure 10:
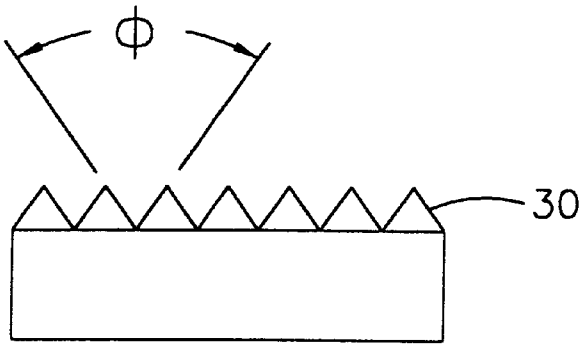
FIG. 10 is a partially fragmentary view illustrating a pyramid type projection design.
Figure 11:
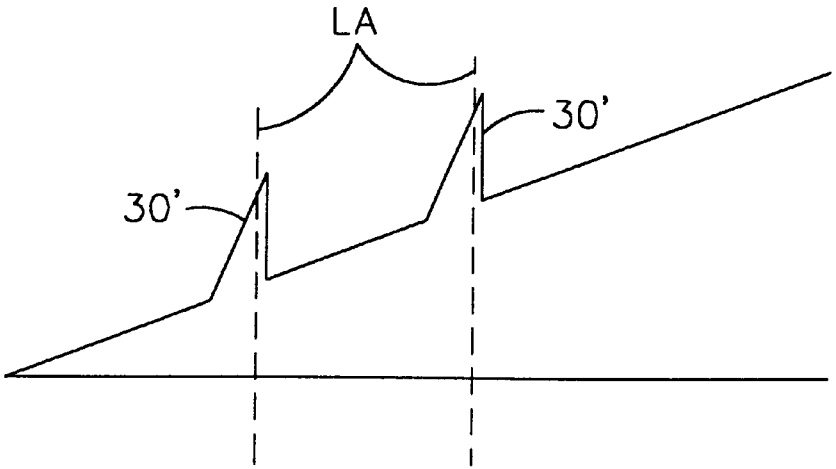
FIG. 11 is a partially fragmentary side elevation view illustrating an angled pyramid projection design.

Referring now to FIGS. 10 and 11, it should be seen that the projection patterns 30 and 54 on the first and second die 4 and 6, respectively, take the form of a plurality of pyramidal shapes which in side view have a silhouette of a serrated edge. However, as is illustrated in perspective view in FIGS. 6 and 8, the projections 30 and 54 are three-dimensional as defined by an array of rows and columns of pyramidal projections, which together made an angle theta (FIG. 10) of about sixty degrees. Alternatively, as seen in FIG. 11, the projections 30' disposed on the first die 4 may take the form of pyramids are which are angled and extend towards the line of action LA in order to make the deformations 24 on the surface 16 substantially normal thereto. In either case, the projections 30, 54 are formed by machining or casting the die pad to create the desired array.

By the foregoing die set has been disclosed by way of illustration. However, numerous modifications and substitutions may be had without departing from the spirit of the invention. For example, the first die 4 may be formed with a die pad which orients the projections at a 0° angle relative to the another so that the die set may be used to crimp for example onto an I-beam rather than onto a flange having an angle of inclination other than 0°.

Accordingly the invention has been described by way of illustration rather than limitation.

What is claimed is:

1. A hydraulic compression tool comprising:

a frame;

a first die and an opposite second die mounted on said frame;

said first die being immovably connected to the frame and said second die being movably connected to the frame along a line of action and positioned oppositely of said first die, said first die being positioned on said frame along said line of action of said second die; and wherein at least one of said first and second die having a work piece engaging surface which is disposed relative to said line of action at an angle other than perpendicular thereto, and wherein said work piece engaging surface of at least one of said first and second dies being a dimpling surface defined by a plurality of pyramids formed thereon extending toward said work piece.

2. A hydraulic compression tool as defined in claim 1 further characterized in that said frame includes a one die holder and another die holder said first die is adapted to be received within the one die holder of said compression tool and said second die is adapted to be received within said other die holder of said compression tool.

3. A hydraulic compression tool as defined in claim 1 further characterized in that at least one of said work piece engaging surfaces disposed relative to said line of action of said second die at an angle other than perpendicular thereto.

4. A hydraulic compression tool as defined in claim 3 further characterized in that said pyramids are angled and extend towards said line of action.

5. A hydraulic compression tool as defined in claim 1 further characterized in that each of said die includes a base and a die pad integrally connected with one another.

6. A hydraulic compression tool as defined in claim 5 further characterized in that each base of said die has a generally partially cylindrical form.

7. A hydraulic compression tool as defined in claim 6 further characterized in that said frame includes one die holder and another die holder said first die is adapted to be received within the one die holder of said compression tool about said generally cylindrical form thereof and said second die is adapted to be received within said other die holder of said compression tool about said generally cylindrical form thereof.

8. A hydraulic compression tool as defined in claim 7 further characterized in that said first die includes a die stop which extends substantially perpendicularly to the die pad portion of said first die.

9. A die set comprising:

a locating die adapted to be mounted to a tool, said locating die having a base portion and a work piece engaging surface for compression against one side of a work piece;

a moving die adapted to be mounted to a tool, said moving die having a base portion and a work piece engaging surface for compression against another side of the work piece;

and wherein said work piece engaging surface of said moving die is disposed at a first angle relative to a given plane, and said work piece engaging surface of said locating die is disposed at a second angle relative to said given plane such that the first and second angles are substantially different from one another, arid wherein said work piece engaging surface of at least one of said locating and moving dies being a portion of a pad having a surface defined by a plurality of pyramids formed thereon extending toward said work piece.

10. A die set as defined in claim 9 wherein said pyramids extend towards said workpiece in a direction generally parallel to said line of action.

11. A die set as defined in claim 10 further characterized in that said work piece engaging surface of said first die being disposed relative to said line of action of said second die at an angle of about 14°.

12. A dimpling die set as defined in claim 11 further characterized in that said each of said first and second dies being formed from a metallic material of suitable hardness for enabling dimpling of a railroad rail when each of aid first and second dies is compressed onto to the rail under compression force.

13. A die set comprising:

a locating die adapted to be mounted to a tool, said locating die having a partially cylindrical base portion and a work piece engaging surface integrally formed therewith for compression against one side of a work piece;

a moving die adapted to be mounted to a tool, said moving die having a partially cylindrical base portion and a work piece engaging surface integrally formed therewith for compression against another side of the work piece;

and wherein said work piece engaging surface of said moving die is disposed at a first angle relative to a given plane and corresponds with an angle of said another side of the work piece and said work piece engaging surface of said locating die being disposed at a second angle relative to the given plane and corresponds with an angle of said one side of the work piece, and wherein said work piece engaging surface of at least one of said moving and locating dies being a surface defined by a plurality of pyramids formed thereon extending toward said work piece.

* * * * *